United States Patent [19]

Ordonez

[11] 4,016,610

[45] Apr. 12, 1977

[54] COMBINATION BED AND DESK

[75] Inventor: Emil Ordonez, Las Vegas, Nev.

[73] Assignee: Raymond Lee Organization, Inc., a part interest

[22] Filed: Sept. 15, 1975

[21] Appl. No.: 613,127

[52] U.S. Cl. ..... 5/2 R

[51] Int. Cl.² ..... A47B 83/00

[58] Field of Search ..... 5/3, 2 B, 2

[56] References Cited

UNITED STATES PATENTS

| | | | |
|---|---|---|---|
| 241,173 | 5/1881 | Wheeler | 5/2 R |
| 445,777 | 2/1891 | Goodwillie | 5/2 R |
| 2,528,871 | 11/1950 | Deuschle | 5/2 R |
| 3,113,324 | 12/1963 | Kamp et al. | 5/3 R |
| 3,471,209 | 10/1969 | Howard | 312/319 |
| 3,858,253 | 1/1975 | Lauzon | 5/2 R |
| D206,427 | 12/1966 | Fowler | 5/2 R |

*Primary Examiner*—Paul R. Gilliam
*Assistant Examiner*—Andrew M. Calvert

[57] ABSTRACT

A horizontal bed has a vertical headboard attached to its front. The headboard forms the back of a deck that is attached to the bed. The deck has a horizontal writing platform that can be slid back and forward with respect to the headboard and can be locked in position by a locking device.

1 Claim, 3 Drawing Figures

COMBINATION BED AND DESK

SUMMARY OF THE INVENTION

This invention is designed for applications where the need exists for a bed and a desk and where space and/or budget for the items is limited. Such applications are college dormitories and student's apartments.

In this invention, the two articles are separated by a vertical headboard attached to both, making each independently usable without interference from the other.

DETAILED DESCRIPTION OF THE PREFERRED EMBODIMENT

Figure 1:
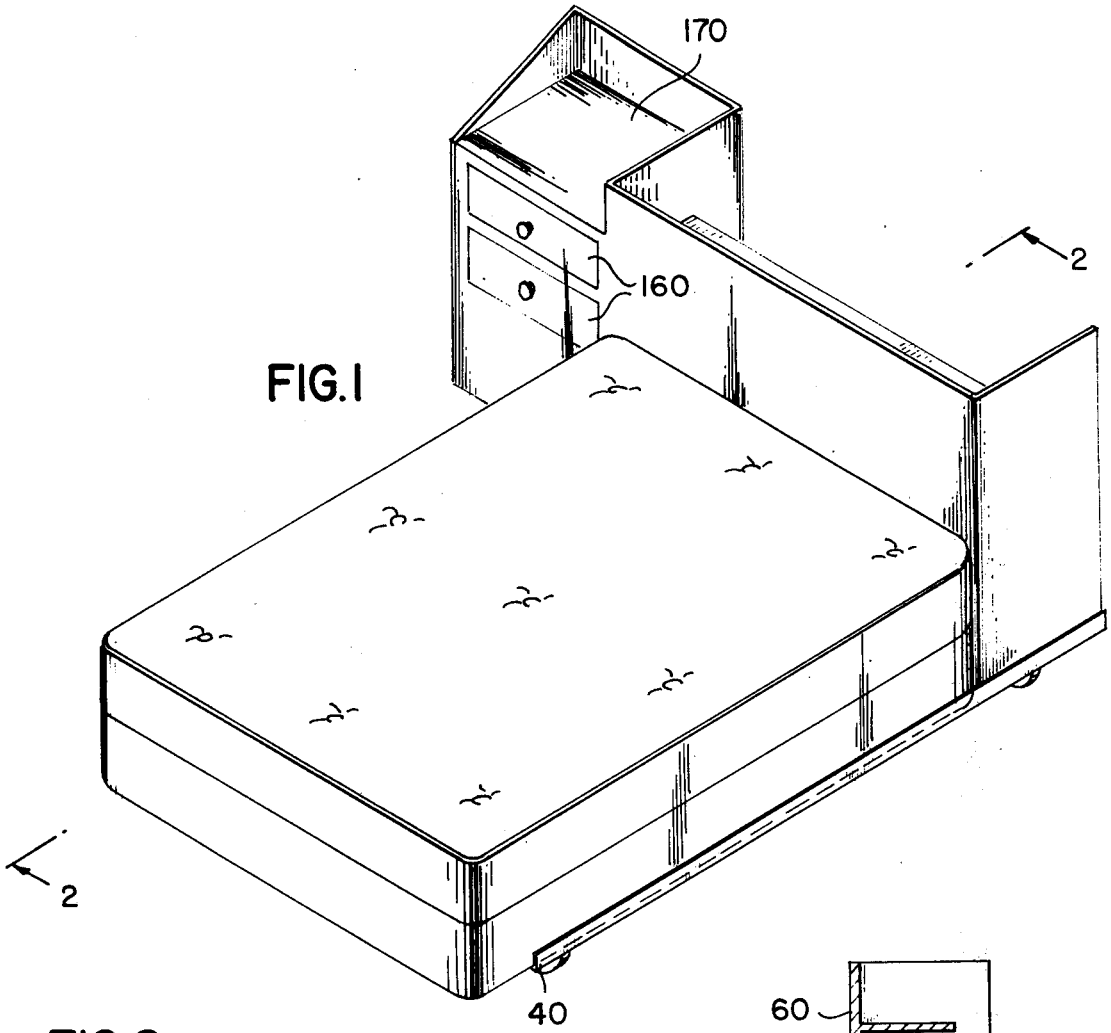
FIG. 1 is a view of the invention looking forwardly.
Figure 2:
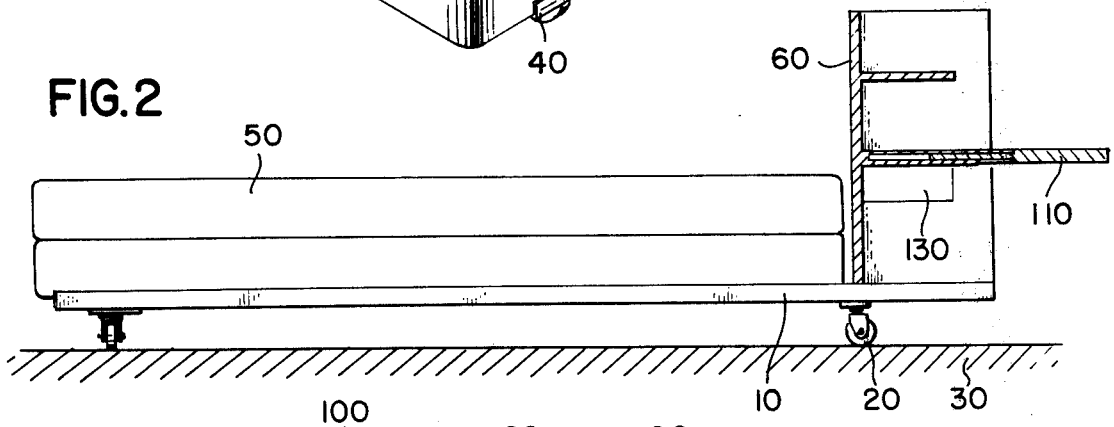
FIG. 2 is a side cross-sectional view of the invention.
Figure 3:
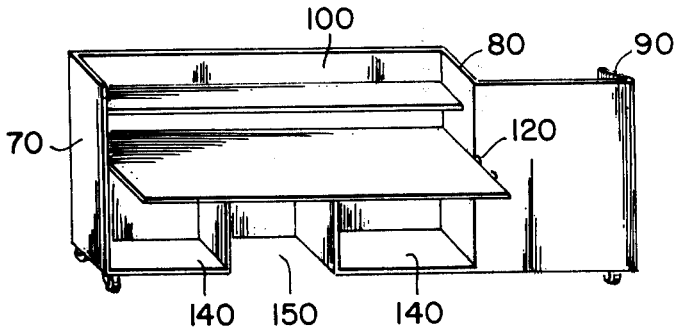
FIG. 3 is a view of the invention looking rearwardly.

A flat, rectangular and horizontal board 10 is supported on four like casters 20 so that the invention can be rolled easily on floor 30. Vertical sidepieces 40 can be placed along the sides of the board to hold a conventional mattress - box spring assembly 50 on top of the board, hanging slightly over its rear edge.

A flat vertical headboard 60 extends transversely across the board 10 directly forwardly of the mattress and box spring. Attached perpendicularly to the headboard are three parallel vertical panels 70, 80 and 90. Panels 70 and 80 are aligned with the sides of the mattress, panel 90 is set off to the left, so that the distance between panels 80 and 90 is approximately half of the distance between panels 70 and 80.

A fixed horizontal shelf 100 extends between panels 70 and 80. Below the shelf, and parallel to it, is a rectangular writing platform 110 that can slide back and forth between the panels with respect to the headboard, allowing adjustment for the size of the user. A locking device 120 is placed on panel 80 to cooperate with the platform and lock it into position. Below the platform is a small drawer 130 for storage of personal items. Two shelves 140 are located to either side of a central recess, below the platform. The recess can accommodate the user's legs, when sitting at the desk.

Between panels 80 and 90 is a bureau. Two drawers 160 extend out of the front of the bureau, out of a continuation of the headboard. The bureau has a horizontal shelf 170 that faces forwardly, to permit the user to reach items on the shelf without leaving the bed.

I claim:

1. A combination bed and desk, comprising:

a horizontal bed;

a vertical headboard attached to the front of the bed;

a bureau with a shelf and drawers located at one end of the headboard with the drawers being operable when pulled rearwardly and the shelf facing rearwardly;

a desk extending forwardly of the headboard and attached to it, so that the headboard forms the back of the desk;

a horizontal writing platform of approximately the width of the bed and slidably located in the desk so as to be slidable forwardly and rearwardly with respect to the headboard; and a locking device cooperating with the platform and desk to fix the platform in the position to which it has been slid.

* * * * *